United States Patent [19]

Ladan et al.

[11] Patent Number: 4,840,105

[45] Date of Patent: Jun. 20, 1989

[54] MINE FIELD CLEARING APPARATUS

[75] Inventors: Uri Ladan, Petach Tikva; Boaz Karton, Meitar; Aron Klipper, Beersheva, all of Israel

[73] Assignee: Israel Aircraft Industries Ltd., Lod, Israel

[21] Appl. No.: 230,662

[22] Filed: Aug. 9, 1988

Related U.S. Application Data

[63] Continuation of Ser. No. 26,387, Mar. 16, 1987, abandoned.

[51] Int. Cl.[4] ..... B63G 7/06; H07F 7/02; F41H 11/12

[52] U.S. Cl. ..... 89/1.13; 335/302

[58] Field of Search ..... 335/302; 89/1.13, 1.11, 89/1.1

[56] References Cited

U.S. PATENT DOCUMENTS

| | | | |
|---|---|---|---|
| 1,268,314 | 6/1918 | Barton . | |
| 1,423,887 | 7/1922 | Stewart . | |
| 2,160,972 | 3/1939 | Litchy | 37/44 |
| 2,298,671 | 10/1942 | Bayes | 37/108 |
| 2,322,115 | 6/1943 | Cox et al. | 97/47 |
| 2,386,025 | 10/1945 | Wills | 89/1.13 |
| 2,388,015 | 10/1945 | Shoemaker | 214/81 |
| 2,425,357 | 8/1947 | Walker | 89/1 |
| 2,460,322 | 2/1949 | Walker | 89/1 |
| 2,479,719 | 1/1948 | Boylen | 55/17 |
| 2,486,372 | 10/1949 | Rockwell | 248/1 |
| 2,489,349 | 11/1949 | White | 55/6 |
| 2,645,745 | 7/1953 | Moreton | 335/302 X |
| 2,747,306 | 5/1956 | Hasenbuhler | 37/45 |
| 2,933,838 | 4/1960 | Rockwell et al. | 37/144 |
| 3,031,779 | 5/1962 | Gwinn et al. | 37/144 |
| 3,106,793 | 10/1963 | Savage | 37/143 |
| 3,238,647 | 3/1966 | Hall et al. | 37/144 |
| 3,292,126 | 12/1966 | Palm | 335/302 |
| 3,513,916 | 5/1970 | Hyler | 172/4 |
| 3,580,340 | 5/1971 | Brown | 172/126 |
| 3,771,413 | 11/1973 | Sieg et al. | 89/1 |
| 3,826,215 | 7/1974 | Dyjak | 335/302 |
| 3,899,762 | 8/1975 | Studders | 335/302 |
| 4,004,167 | 1/1977 | Meckling | 335/302 |
| 4,021,725 | 5/1977 | Kirkland | 89/1.13 |
| 4,279,138 | 7/1981 | van der Lely | 172/4 |
| 4,326,908 | 4/1982 | Hoya et al. | 335/302 |
| 4,372,441 | 2/1983 | Krammer | 198/781 |
| 4,384,620 | 5/1983 | Uchida et al. | 172/815 |
| 4,443,776 | 4/1984 | Cunningham | 335/302 |
| 4,467,694 | 8/1984 | Azulai et al. | 89/1.13 |
| 4,491,053 | 1/1985 | Bar-Nefy et al. | 89/1.13 |
| 4,552,053 | 5/1983 | Bar Nefi et al. | 89/1.13 |
| 4,590,844 | 10/1983 | Bar Nefi et al. | 89/1.13 |
| 4,593,766 | 6/1986 | Gossard | 89/1.13 |
| 4,690,030 | 9/1984 | Bar Nefi et al. | 89/1.13 |
| 4,727,940 | 12/1985 | Bar Nefi et al. | 171/84 |

FOREIGN PATENT DOCUMENTS

| | | | |
|---|---|---|---|
| 1457997 | 6/1964 | Fed. Rep. of Germany . | |
| 2139897 | 8/1971 | Fed. Rep. of Germany . | |
| 2430709 | 1/1976 | Fed. Rep. of Germany . | |
| 2715061 | 4/1977 | Fed. Rep. of Germany . | |
| 2715108 | 4/1977 | Fed. Rep. of Germany . | |
| 2755100 | 12/1977 | Fed. Rep. of Germany . | |
| 2632568 | 1/1978 | Fed. Rep. of Germany . | |
| 2843594 | 10/1978 | Fed. Rep. of Germany . | |
| 3316005 | 11/1984 | Fed. Rep. of Germany | 89/1.13 |
| 914285 | of 1946 | France . | |
| 682611 | 8/1979 | U.S.S.R. . | |
| 690664 | 4/1953 | United Kingdom . | |
| 744035 | 1/1956 | United Kingdom . | |
| 2106454 | 9/1982 | United Kingdom . | |

OTHER PUBLICATIONS

Jane's Combat Support Equipment, 1st ed. 1978–79, ed. C. F. Foss Macdonald & Jane's Pub. Ltd., London 1978, p. 178.

Minenraum–Anbaugerat KMT–5 Soldant und Technik, 4/1976, pp. 176–178.

*Primary Examiner*—David H. Brown

*Attorney, Agent, or Firm*—Shapiro and Shapiro

[57] ABSTRACT

An element for exploding magnetic mines comprising a permanent magnet arranged for driven engagement with a ground surface thereby providing rotation thereof, the permanent magnet being disposed at a distance in front of a vehicle to be protected from mines, whereby action of the permanent magnet provides premature detonation of mines in the vicinity thereof at a safe distance in front of the vehicle.

12 Claims, 2 Drawing Sheets

MINE FIELD CLEARING APPARATUS

This is a continuation application of Ser. No. 026,387 filed Mar. 16, 1987, now abandoned.

FIELD OF THE INVENTION

The present invention relates to apparatus for clearing mines and more particularly to mine clearing apparatus mountable on an armoured vehicle such as a tank.

BACKGROUND OF THE INVENTION

It is known in tank warfare to employ mine clearing apparatus mounted on a vehicle for clearing a path through a mine-field.

There is described and claimed in U.S. Pats. Nos. 4,491,053 and 4,467,694, both to the assignee of the present application, mine field clearing apparatus mountable on a vehicle which comprises a pair of plows arranged in front of the treads of the vehicle. In FIG. 1 of both of the aforesaid U.S. Pats. Nos. there is shown a weight in the general form of a "dog bone" disposed on a chain which extends between the two plow sections joining same.

SUMMARY OF THE INVENTION

The present invention relates to an element which may be employed in place of the "dog bone" weight illustrated in the aforesaid U.S. Pats. Nos. of assignee.

There is thus provided in accordance with an embodiment of the present invention an element for exploding magnetic mines comprising a permanent magnet arranged for driven engagement with a ground surface thereby providing rotation thereof, the permanent magnet being disposed at a distance in front of a vehicle to be protected from mines, whereby action of the permanent magnet provides premature detonation of mines in the vicinity thereof at a safe distance in front of the vehicle.

Further in accordance with a preferred embodiment of the present invention, the permanent magnet comprises at least one magnet arranged to define a longitudinal axis, the permanent magnet being magnetized in a direction perpendicular to its longitudinal axis, the magnet being arranged for driven engagement with the ground surface such that it rotates about its longitudinal axis.

Additionally in accordance with a preferred embodiment of the present invention, the permanent magnet is enclosed in a shock resistant covering. Further in accordance with an embodiment of the invention, the shock resistant covering is surrounded by a rigid sleeve. Additionally in accordance with the invention, the rigid sleeve is surrounded by a further impact resistant covering.

Further in accordance with an embodiment of the invention, the magnet is bearing mounted with respect to a mounting chain for relatively free rotation with respect thereto.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENTS

Figure 1:
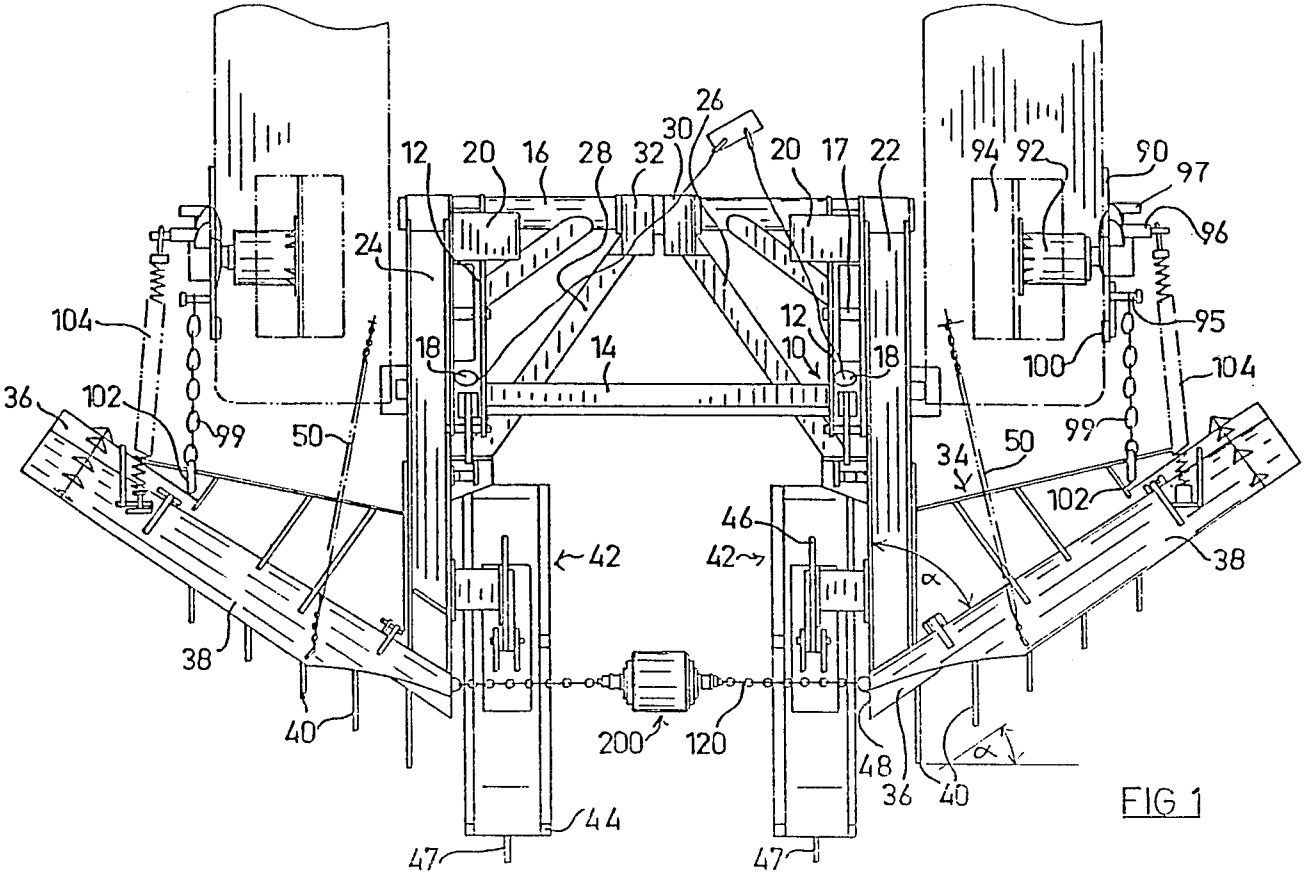
FIG. 1 is a top view of minefield clearing apparatus constructed and operative in accordance with a preferred embodiment of the present invention.

Reference is now made to FIG. 1, which illustrates mine clearing apparatus constructed and operative in accordance with an embodiment of the present invention. As seen in the illustration, the mine clearing apparatus comprises a frame 10 including a pair of identical side portions 12, which are joined at their front end by a cross bar 14 and at their rear end support by an axle 16. Frame 10 is rigidly mounted onto an armoured vehicle, such as an M-60 tank, by engagement of pins 17 located at side portions 12 with towline lugs fixed onto the tank. Rigidity of mounting is provided by bolts 18 which engage the underside of the tank and force mounting plates 20, fixedly mounted onto side portions 12 on the opposite side of pins 17, into tight engagement with the underside hull of the tank.

First and second arms 22 and 24 are independently rotatably mounted onto axle 16 and extend forwardly thereof in generally parallel planes. Arms 22 and 24 are strengthened by reinforcing elements 26 and 28 respectively which are fixed at one end thereof to the respective arms and are rotatably mounted by means of clamps 30 and 32 onto axle 16.

Rigidly mounted onto each of arms 22 and 24 is a mine plowing assembly 34. Mine plowing assembly 34 comprises main plow portion 36 of generally elongate configuration and concave cross section.

The general configuration of main plow portion 36 may be similar to that of an ordinary vehicle - powered snow plow. Disposed above main plow portion 36 and hinged thereonto is an auxiliary plow portion 38. Auxiliary plow portion 38 has two positions, a lowered position in which it extends forwardly of the surface of the main plow portion 36 and a raised position in which it defines an upper continuation of the surface of the main plow portion 36. This hinged construction is to obviate the problem of interference with a driver's field of vision or with the range of operation of the armament on a tank. Towards this end, the hinged auxiliary plow portion 38 may be lowered when the plowing assembly 34 is in its raised orientation.

Disposed below main plow portion 36 there are provided a plurality of vertically disposed planar blades 40, which during operation are disposed below the ground surface. The horizontal spacing between adjacent vertical blades is selected to be such that anti-vehicle mines will of necessity be engaged thereby. The blades are provided with an inclined forward surface, so as to raise mines located under the ground surface into engagement with main plow poriton 36, so that they may be plowed aside.

A desired depth of operation for blades 40 is determined by means of a gliding surface assembly 42 which is articulatedly mounted onto each of arms 22 and 24. The gliding surface assembly 42 comprises a sled 44 which is arranged to slide on the ground surface and is formed at its front with a vertical blade 47 for deflecting mines to the side thereof. Sled 44 is rotatably mounted onto a cam slot of a mounting plate 46. Mounting plate 46 is mounted in turn onto a mounting element 48. It is appreciated that sled 44 is permitted to undergo a somewhat complex articulated motion in a single plane within limits defined by the respective cam paths. This mounting arrangement permits selectable adjustment of the penetration depth of the plowing assembly 34 and also permits the sled 44 to be folded when the plowing assembly is in its raised orientation to eliminate interference with operation of the tank.

A chain 50 extends from each auxiliary plow portion 38 to a location on the tank hull. The length of the chain 50 is selected such that it is slack when the plowing assembly is in its raised orientation but becomes tight when the plowing assembly is lowered, thus pulling on auxiliary plow portion 38 and orienting it towards a generally vertical orientation. The full raised orientation of the auxiliary plow portion 38 is reached only when soil being plowed is forced thereagainst.

Apparatus for automatically lifting the mine plowing assembly is provided separately for each mine plow and comprises a freely rotatable disk 90 which is bearing mounted onto a mounting member 92 which is bolted onto a tension wheel 94 of a tank. Tension wheel 94 engages the tread of the tank and maintains it at a desired tension. Mounted on an outer facing surface of disk 90 are three outer pins 95, 96 and 97 and an inner disposed pin (not shown). Mounted on an inner facing surface of disk 90 is a tooth 100 which is disposed ordinarily out of engagement with corresponding interstices defined between plates of the tank tread.

Mounted on pin 95 is a lifting chain 99 which is attached at its other end to a location 102 fixed onto main plow portion 36. Mounted on pin 96 is a spring 104 which is attached at its other end to main plow portion 36. Spring 104 is operative when in the orientation illustrated in FIG. 1, to urge disk 90 to rotate about its axis in a clockwise direction.

The operation of all of the apparatus described hereinabove is described and illustrated in detail in U.S. Pat. No. 4,467,694, the disclosure of which is incorporated herein by reference.

A weighted chain 120 is mounted between the two plowing assemblies to engage and detonate any mines that are encountered in front of the intermediate portion of the tank at a safe distance from the tank.

Figure 2:
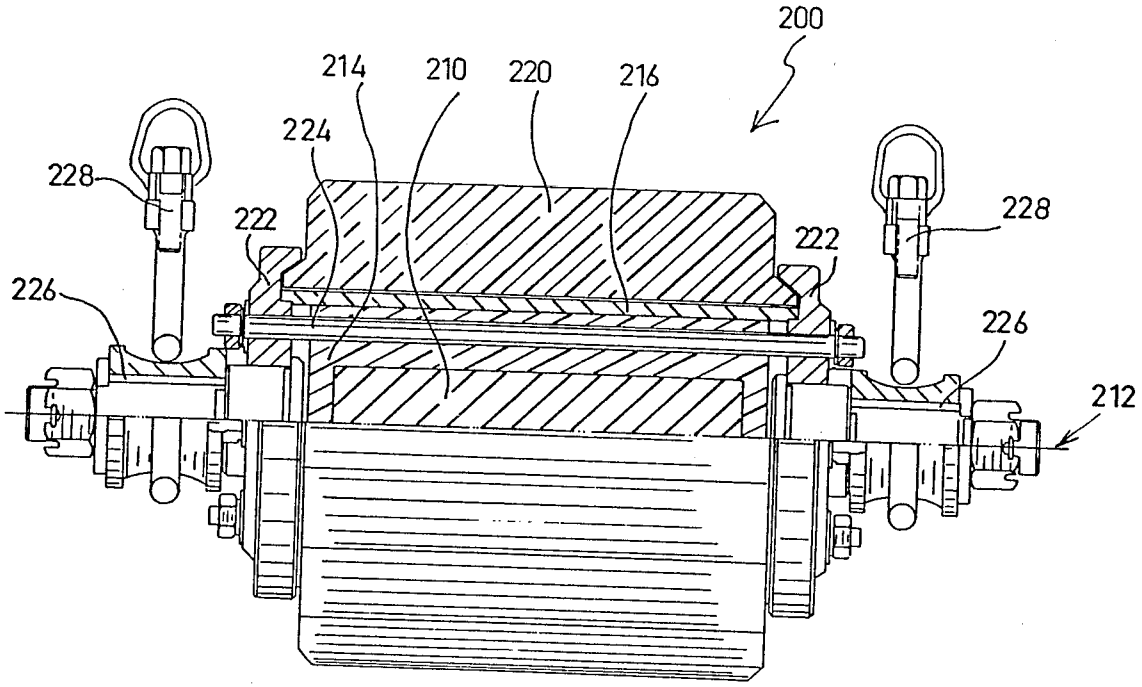
FIG. 2 is a partially cut away side view of a magnetic mine exploding device useful in the apparatus of FIG. 1 in accordance with a preferred embodiment of the present invention.

In accordance with a preferred embodiment of the invention, there is mounted onto the chain an element 200 for exploding magnetic mines which is more closely illustrated in FIG. 2.

The element of FIG. 2 preferably comprises a permanent magnet 210, typically comprising one or more permanent magnets of conventional composition arranged along a longitudinal axis 212. Permanent magnet 210 is preferably magnetized in a direction perpendicular to longitudinal axis 212.

Surrounding permanent magnet 210 on all sides there is provided a shock absorbing material 214 such as RTV rubber. Surrounding the shock absorbing material 214 there is provided a rigid, impact-resistant cylindrical sleeve 216, formed of a paramagnetic material such as aluminum or any other suitable material such as plastic. Formed about sleeve 216 is a relatively thick layer 220 of shock absorbing material, such as rubber.

The assembly is preferably held together by a pair of end clamps 222, which are typically held together by elongate bolts 224, of paramagnetic material, which pass through material 214.

The assembly is rotatably mounted onto chain 120 (FIG. 1) by means of bearing mounts 226, formed on either side of the magnet 210, onto which are formed attachment members 228 for attachment to chain 120.

It is a particular feature of the present invention that the assembly shown in FIG. 2 is mounted for rotatable engagement with a ground surface during movement of tank onto which it is mounted, thus producing rotation of magnet 210 about its longitudinal axis whereby a varying magnetic field is produced in the vicinity of magnetic mines, producing detonation thereof at a safe distance in front of the tank.

It will be appreciated by persons skilled in the art that the present invention is not limited by what has been particularly shown and described hereinabove. Rather the scope of the present invention is defined only by the claims which follow:

We claim:

1. Apparatus for exploding magnetic mines comprising:

a permanent magnet disposed at a distance in front of a vehicle to be protected from mines and means for producing rotation of the permanent magnet thereby to cause premature detonation of mines in the vicinity thereof and without causing unacceptable damage to the vehicle or occupants of the vehicle.

2. Apparatus according to claim 1 and also comprising a mounting chain for mounting said permanent magnet onto said vehicle and bearing means mounting said magnet with respect to said mounting chain for relatively free rotation with respect thereto.

3. Apparatus according to claim 1 and wherein said permanent magnet comprises at least one magnet arranged to define a longitudinal axis, the permanent magnet being magnetized in a direction perpendicular to the longitudinal axis, and the magnet being arranged for driven engagement with a ground surface such that it rotates about the longitudinal axis.

4. Apparatus according to claim 3 and wherein said permanent magnet is enclosed in a shock resistant covering.

5. Apparatus according to claim 3 and also comprising a mounting chain for mounting said permanent magnet onto said vehicle and bearing means mounting said magnet with respect to said mounting chain for relatively free rotation with respect thereto.

6. Apparatus according to claim 1 and wherein said permanent magnet is enclosed in a shock resistant covering.

7. Apparatus according to claim 6 and also comprising a mounting chain for mounting said permanent magnet onto said vehicle and bearing means mounting said magnet with respect to said mounting chain for relatively free rotation with respect thereto.

8. Apparatus according to claim 6 and wherein said shock resistant covering is surrounded by a rigid sleeve.

9. Apparatus according to claim 8 and also comprising a mounting chain for mounting said permanent magnet onto said vehicle and bearing means mounting said magnet with respect to said mounting chain for relatively free rotation with respect thereto.

10. Apparatus according to claim 8 and wherein said rigid sleeve is surrounded by an impact resistant covering.

11. Apparatus according to claim 10 and also comprising a mounting chain for mounting said permanent magnet onto said vehicle and bearing means mounting said magnet with respect to said mounting chain for relatively free rotation with respect thereto.

12. In combination with a vehicle including a pair of vehicle treads, mine clearing apparatus comprising:

means mounted onto the vehicle for raising and shunting aside mines in front of said vehicle treads and means disposed in front of said vehicle and intermediate said vehicle treads for exploding magnetic mines, comprising a permanent magnet disposed at a distance in front of the vehicle and means for producing rotation of the permanent magnet thereby to cause premature detonation of mines in the vicinity thereof without causing unacceptable damage to the vehicle or occupants of the vehicle.

* * * * *